US010168634B2

(12) United States Patent
Uchiyama

(10) Patent No.: US 10,168,634 B2
(45) Date of Patent: Jan. 1, 2019

(54) IMAGE FORMING APPARATUS CAPABLE OF SETTING A PARAMETER USED IN FORMING AN IMAGE BASED ON A DETECTED CHANGE IN A VALUE OF TINT

(71) Applicant: CANON KABUSHIKI KAISHA, Tokyo (JP)

(72) Inventor: Akihiko Uchiyama, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/629,388

(22) Filed: Jun. 21, 2017

(65) Prior Publication Data

US 2017/0371262 A1 Dec. 28, 2017

(30) Foreign Application Priority Data

Jun. 27, 2016 (JP) ..... 2016-126720

(51) Int. Cl.
*G03G 15/01* (2006.01)
*G03G 15/00* (2006.01)

(52) U.S. Cl.
CPC ..... *G03G 15/0178* (2013.01); *G03G 15/5008* (2013.01); *G03G 15/5041* (2013.01)

(58) Field of Classification Search
CPC ..... G03G 15/0827; G03G 15/0187; G03G 15/5008; G03G 15/5041
See application file for complete search history.

(56) References Cited

U.S. PATENT DOCUMENTS

2015/0185675 A1* 7/2015 Tamura ..... G03G 15/556 399/49
2015/0316885 A1* 11/2015 Uematsu ..... G03G 15/5037 399/49

FOREIGN PATENT DOCUMENTS

| | | | |
|---|---|---|---|
| JP | H08-146749 | A | 6/1996 |
| JP | 2005-283898 | A | 10/2005 |
| JP | 2009-143188 | A | 7/2009 |
| JP | 2015-127754 | A | 7/2015 |

* cited by examiner

*Primary Examiner* — Hoang Ngo
(74) *Attorney, Agent, or Firm* — Canon U.S.A., Inc. IP Division

(57) ABSTRACT

An image forming apparatus includes a CPU configured to change a parameter value used to control a developer bearing amount and form a plurality of patches for different parameter values changed, and a color sensor configured to measure the plurality of patches thereby acquiring color information thereof. The CPU detects, from values of color information of the plurality of patches, a value of the color information at which a change greater than or equal to a predetermined threshold value occurs, and the CPU sets a parameter used in forming an image based on the detected value of color information.

20 Claims, 7 Drawing Sheets

IMAGE FORMING APPARATUS CAPABLE OF SETTING A PARAMETER USED IN FORMING AN IMAGE BASED ON A DETECTED CHANGE IN A VALUE OF TINT

BACKGROUND

Field of the Disclosure

The present disclosure generally relates to image forming and, more particularly, to an image forming apparatus using an electrophotographic method such as a printer, a copying machine, or the like.

Description of the Related Art

To obtain a color image with high image quality, it is generally important to output color components including yellow (Y), magenta (M), cyan (C), and black (Bk) such that the density of each color component is properly controlled in forming the color image. In view of the above, in color image forming apparatuses using the electrophotographic method, it is known to use an image density control technique to obtain an output image with color components with stably controlled density. In the image density control technique, a toner image called a patch is experimentally formed on an image bearing member, and the density of the toner image (the toner bearing amount) is detected using a density sensor and fed back to an image formation condition such as a peripheral speed of a development roller, or the like (see, for example, Japanese Patent Laid-Open No. 08-146749).

The density sensor is generally realized using a combination of a light emitting device such as an LED and a photodetector such as a photodiode or a cadmium sulfide cell (CdS). A surface of an intermediate transfer belt or the like to be measured is illuminated with light from the light emitting device, and specular reflection light from the surface of the intermediate transfer belt is detected by there by the photodetector. When toner is put on the intermediate transfer belt, a reduction in intensity of specular reflection light occurs depending on an amount of toner put thereon (hereinafter, referred to as a toner bearing amount), and this change in light intensity is detected by the density sensor and output from the density sensor. FIG. 7A is a graph in which a vertical axis represents the output of the density sensor and a horizontal axis represents the toner bearing amount. As shown in FIG. 7A, the output from the density sensor tends to decrease as the toner bearing amount (the toner density) increases. Therefore, when an image used as the patch in the image density control is an image of a type that consumes a large toner bearing amount (hereinafter such an image will be referred to as a solid image), the output has a small change in response to a change in the toner bearing amount, which makes it difficult to accurately detect the toner bearing amount. To avoid the above situation, instead of a solid image, an image that is small in toner bearing amount and great in change in output compared to the solid image is used. In the conventional image density control, a change in density of a solid image is estimated from a change in output for an image that consumes smaller in toner bearing amount than is consumed by the solid image, and the density of the solid image is controlled based on the estimation. However, depending on the condition of using toner, the density obtained after the control is not necessarily what is expected. In particular, when the toner bearing amount is greater than is necessary, the following problems may occur.

FIG. 7B illustrates an example of a change in chromaticity that may occur when the bearing amount of cyan toner is increased. In this figure, chromaticity is plotted in an a*-b* plane. The toner bearing amount increases in a direction denoted by a thick solid arrow in FIG. 7B. In FIG. 7B, an optimum toner bearing amount is obtained near a point denoted by $\alpha$, and this toner bearing amount usually provides a maximum density. As may be seen from FIG. 7B, when a greater amount of toner than is necessary is borne beyond the point $\alpha$, a great change occurs in hue angle $\theta$. In other words, in FIG. 7B, plotted points are on a solid line of a hue angle $\theta$1 as far as the bearing amount of tone is within a proper range, but once the bearing amount of tone increases beyond the point $\alpha$, plotted points are on a dot line of a hue angle $\theta$2 different from $\theta$1. The occurrence of the large change in hue angle $\theta$ indicates an occurrence of an abrupt change in tint near the maximum density. A possible reason for such a change in tint is a nonuniform distribution of a colorant within toner, and thus a resultant nonuniform distribution of the colorant on a fixed image. When the toner bearing amount is small, the nonuniform distribution of the colorant does not have a significant influence. However, when the toner bearing amount is excessive the nonuniform distribution of the colorant may cause a change in a tint. In image processing performed by a color image forming apparatus, it is generally assumed that a change in tint occurs gradually and monotonically. Therefore, a large change in tint may result in a deviation of a color balance in an output image, which may cause not only a reduction in image quality but also an increase in consumption of toner.

SUMMARY

According to one or more aspects of the present disclosure, an image forming apparatus includes a plurality of forming units respectively corresponding to a plurality of colors, each forming unit including a photosensitive member on which a latent image is formed and a developing unit configured to develop, using a developer, the latent image formed on the photosensitive member thereby forming a developer image, a control unit configured to change a parameter used to control a developer bearing amount and control the forming units to form a plurality of detection images according to different parameters, and a color measurement unit configured to measure a plurality of values of tint according to the plurality of detection images formed by the forming units, the control unit being configured to specify a value, among the plurality of values of tint, showing a change in tint greater than or equal to a predetermined amount, and set a parameter for use in forming the image depending on the value showing the change in tint greater than or equal to the predetermined amount.

Further features of the present disclosure will become apparent from the following description of exemplary embodiments with reference to the attached drawings.

DESCRIPTION OF THE EMBODIMENTS

Embodiments according to one or more aspects of the present disclosure are described below with reference to drawings. Note that these embodiments are described by way of example only and not limitation. Also note that all parts, elements, or steps described in embodiments are not necessarily needed to practice the present disclosure.

First Embodiment

Image Forming Apparatus

Figure 1:
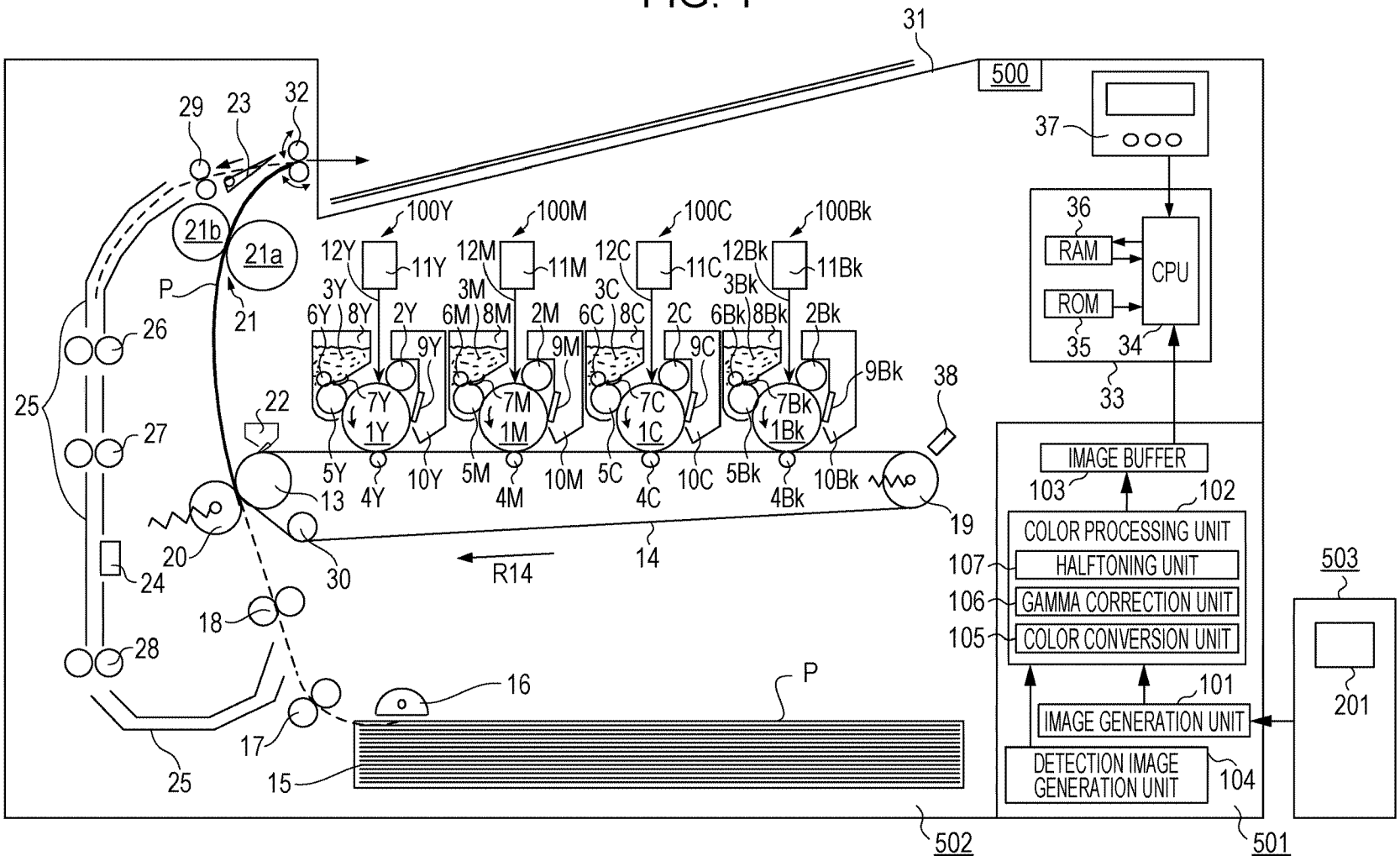
FIG. 1 is a schematic diagram illustrating a configuration of an image forming apparatus according to one of first to third embodiments.

FIG. 1 is a schematic diagram illustrating a configuration of an image forming apparatus 500 according to a first embodiment. The image forming apparatus 500 may operate as a stand-alone apparatus or may be connected to a host computer 503 via a network. Image data generated by application software or the like operating on the host computer 503 is output as print information via a printer driver 201 and transmitted to an image processing unit 501 in the image forming apparatus 500. The print information is described in a printer description language called a page description language (PDL) including commands for printing characters, graphics, images, and/or the like. The image processing unit 501 includes an image generation unit 101, a color processing unit 102, an image buffer 103, and a detection image generation unit 104. The print information transmitted to the image processing unit 501 is analyzed and rasterized by the image generation unit 101 and is separated into three pieces of print information of bit map image data of red (R), green (G), and blue (B), and the resultant three pieces of print information are output to the color processing unit 102.

The units described throughout the present disclosure are exemplary and/or preferable modules for implementing processes described in the present disclosure. The modules can be hardware units (such as circuitry, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

The color processing unit 102 includes a color conversion unit 105, a gamma correction unit 106, and a halftoning unit 107. The three pieces of bit map image data of R, G, and B output to the color processing unit 102 are converted as follows. That is, the bit map image data represented using R, G, and B color components (hereinafter such data is also referred to simply as RGB image data) is converted by the color conversion unit 105 to image data represented using Y, M, C, and Bk color components (hereinafter such data is also referred to simply as YMCK image data) according to a data conversion table defining a correspondence between RGB image data and YMCK image data. Furthermore, the image data is subjected to a gamma correction in the gamma correction unit 106 to correct the image data such that a predetermined relationship is satisfied between the resultant corrected image data and the density of an image output by an engine unit 502 described later. The gamma correction is performed using a look-up table (hereinafter referred to as an LUT) defining a correspondence between input image data and an output image data. The image data subjected to the gamma correction performed by the gamma correction unit 106 is further subjected to a halftoning process such as dithering in the halftoning unit 107, and resultant image data is stored in the image buffer 103. The image data stored in the image buffer 103 is transmitted to the engine unit 502 with particular timing in an image forming process. The detection image generation unit 104 generates a detection image detected by a density sensor 38 or a color sensor 24 which will be described later.

Next, the engine unit 502 is described below. The control unit 33 is capable of communicating with the image processing unit 501 and controls the operation of the engine unit 502 according to a command received from the image processing unit 501. The control unit 33 includes a central processing unit (CPU) 34, a read-only memory (ROM) 35 which is a read-only memory in which a program and/or various kinds of data used by the CPU 34 are stored, a random access memory (RAM) 36 which is a readable and writable memory and is used as a work area used in data processing, and the like. The CPU 34 functioning as a control unit, which may include one or more processors and one or more memories, is connected to an operation panel 37 used by a user to make various settings and input a command and also used to present information to the user.

The engine unit 502 is a tandem-type full-color image forming apparatus using an intermediate transfer method. Four image forming units 100Y, 100M, 100C, and 100Bk respectively for forming toner images, i.e., developer images, of Y, M, C, and Bk colors are arranged horizontally in an upstream to downstream direction in a moving path of an intermediate transfer belt 14 described later. Hereinafter, suffixes Y, M, C, and Bk added at the end of the reference numeral 100 for respective image forming units will be omitted unless colors are distinguished in the explanation. The intermediate transfer belt 14 is disposed below the image forming unit 100 such that the intermediate transfer belt 14 is stretched by rollers 13, 19, and 30. Each image forming unit 100 includes an integrated-type process cartridge including a drum unit 10 and a development unit 8. The drum unit 10 includes a photosensitive drum 1 which is a photosensitive member including an organic photo conductor (OPC) photosensitive layer, a cleaning member 9 including an elastic blade, and a charging roller 2 functioning as a charging unit. The development unit 8 includes a developing roller 5 functioning as a development unit, non-magnetic single component toner 3 functioning as a developer charged negatively, a toner supply roller 6, and a toner supply blade 7. Note that the image forming unit 100 functioning as a forming unit includes at least the photosensitive drum 1 and the developing roller 5. A plurality of forming units corresponding to a plurality of colors are provided. In the present embodiment, as described above, four image forming units 100 corresponding to four colors are provided. Note that in the present embodiment, the developing rollers 5Y, 5M, 5C, and 5K are driven independently.

Each image forming unit 100 includes an exposure apparatus 11 functioning as an exposure unit including a scanner unit configured to scan laser light using a polygonal mirror.

The exposure apparatus 11 illuminates the photosensitive drum 1 with a scanning beam 12 modulated based on the image data thereby forming an electrostatic latent image (a latent image). In the present embodiment, the image data is represented by 8-bit data for each color, that is, represented in 256 levels from 00H to FFH (H indicates that values are expressed in hexadecimal). When image data has a value of FFH, the image data represents a solid image. As the value of the image data decreases, the image density decreases. When the image data has a value of 00H, no image is displayed (that is, a solid white image is displayed). On an inner side of the intermediate transfer belt 14, primary transfer rollers 4 are disposed such that each primary transfer roller 4 presses the intermediate transfer belt 14 against corresponding one of the photosensitive drums 1. The primary transfer roller 4 is applied with a positive voltage supplied from a voltage regulated power supply (not shown) whereby the toner image formed on the photosensitive drum 1 is transferred to the intermediate transfer belt 14.

A secondary transfer roller 20 transfers the toner image formed on the intermediate transfer belt 14 to a recording material P. The secondary transfer roller 20 is applied with a positive voltage supplied from a current regulated power supply (not shown). Of the three rollers 13, 19, and 30 supporting the intermediate transfer belt 14, the roller 13 is a roller opposing the secondary transfer roller and also serving as a driving roller. The roller 13 is configured to drive the intermediate transfer belt 14 to move in a direction denoted by an arrow R14 (in a clockwise direction). The roller 13 forms, together with the recording material P, a secondary transfer nip via the recording material P. The roller 30 is an auxiliary roller for keeping a specific angle, in the vicinity of the secondary transfer nip, between the recording material P and the surface of the intermediate transfer belt 14 thereby preventing an abnormal discharge from occurring between the recording material P and the toner image on the intermediate transfer belt 14. The roller 19 is a tension roller for stretching the intermediate transfer belt 14 with a specific tension. At a downstream location on the roller 13, disposed is a cleaning member 22 including an elastic blade for cleaning toner remaining on the intermediate transfer belt 14 without being transferred to the recording material P in the secondary transfer nip. Note that a combination of the primary transfer roller 4, the intermediate transfer belt 14, and the secondary transfer roller 20 functions as a transfer unit configured to transfer the toner image formed on the photosensitive drum 1 (the photosensitive member) to the recording material.

The fixing apparatus 21 functioning as a fixing unit includes a fixing roller 21*a*, and a pressure roller 21*b* and serves to fixing the toner image by heating and pressing the unfixed toner image formed on the recording material P. A discharge roller pair 32 discharges the fixed recording material P to a tray 31. A flapper 23 guides the recording material P reversed by the discharge roller pair 32 to a duplex conveying roller pair 29. The recording material P is further conveyed by duplex conveying roller pairs 26, 27, and 28 along a duplex conveying path 25 until the recording material P again reaches a registration roller pair 18. Note that the duplex conveying path 25 is a conveying path along which to convey a recording material to form an image on a second surface of the recording material after an image formed on a first surface thereof.

Image Forming Operation

Next, an image forming operation performed by the image forming apparatus 500 is described below. When the image forming process is started, an initial operation is performed to start rotating the photosensitive drums 1 and the intermediate transfer belt 14 at predetermined speeds in directions denoted by arrows. Each photosensitive drum 1 is uniformly charged to a specific potential Vd by the corresponding charging roller 2 applied with a specific charging voltage. Subsequently, the scanning beam 12 from the exposure apparatus 11 strikes the photosensitive drums 1 so as to form electrostatic latent images based on the image data. The electrostatic latent images of the four colors formed on the photosensitive drums 1 corresponding to the respective colors are mixed together on the intermediate transfer belt 14. Note that timings of transferring the electrostatic latent images from the photosensitive drums 1 to the intermediate transfer belt 14 are controlled such that a full color image is correctly obtained. The potential appearing on the surface of each photosensitive drum 1 when being exposed to light so as to form a solid image with image data of FFH is referred to as Vl. A difference in potential between the potential Vl appearing when being exposed to light and the potential Vd appearing when being charged is referred to as a latent image contrast.

When each exposed photosensitive drum 1 further rotates, the electrostatic latent image on the photosensitive drum 1 is visualized (developed) by a corresponding one of the developing rollers 5 applied with the development voltage. In the present embodiment, the developing rollers 5 rotate at predetermined peripheral speeds by being driven by different driving units (not shown) such as motors or the like. To stably supply proper amounts of toner to the photosensitive drums 1, the developing rollers 5 are driven so as to rotate at peripheral speeds greater than the peripheral speeds of the photosensitive drums 1 by specific ratios, that is, driven so as to obtain specific peripheral speed ratios.

By the operations of the developing roller 5*s* applied with the development voltage and rotating at the specific peripheral speed ratios relative to the photosensitive drums 1, Y, M, C, and Bk toner images are formed on the respective photosensitive drums 1Y, 1M, 1C, and 1Bk. When the photosensitive drum 1Y further rotes, the yellow toner image on the photosensitive drum 1Y is transferred, by the primary transfer roller 4Y applied with a primary transfer voltage, to the intermediate transfer belt 14. In synchronization with the movement of the intermediate transfer belt 14, toner images of M, C, and Bk colors are sequentially transferred in a superimposed manner to the intermediate transfer belt 14 by the respective primary transfer rollers 4M, 4C, and 4Bk thereby forming a four-color toner image on the intermediate transfer belt 14.

From a stack of recording materials P put in a paper feed cassette 15, recording materials P are fed by a crescentic-shaped paper feed roller 16 and one sheet of recording material P is taken by a separation roller 17. The one sheet of recording material P is conveyed to a registration roller pair 18 and is stopped there temporarily. In synchronization with the arrival of the four-color toner image on the intermediate transfer belt 14 at the secondary transfer nip, the recording material P in the temporary stop state is conveyed by the registration roller pair 18 to the secondary transfer nip, and a voltage is applied between the secondary transfer roller 20 and the roller 13 thereby transferring the toner image on the intermediate transfer belt 14 to the recording material P. After the toner image is transferred to the recording material P, the recording material P is separated from the intermediate transfer belt 14 and conveyed to the fixing apparatus 21. The unfixed toner image on the recording material P is heated and pressed between the fixing roller 21*a* and the pressure roller 21*b* in the fixing apparatus 21 such that the toner image is fixed on the surface of the recording material P.

Residual toner remaining on the photosensitive drums 1 without being transferred to the intermediate transfer belt 14 is removed by the cleaning members 9 and collected in a waste toner container. On the other hand, toner remaining on the intermediate transfer belt 14 without being transferred to the recording material P is removed by the cleaning member 22 and collected in a waste toner container (not shown).

In a case where an image is formed only on one side (first side) of the recording material P, After the fixing by the fixing apparatus 21 is performed, the recording material P is discharged by the discharge roller pair 32 to the tray 31, and the image forming is completed. On the other hand, in a case where images are formed on both sides of the recording material P, when a trailing end of the recording material P reaches the discharge roller pair 32 after the fixing is ended for the first side, the discharge roller pair 32 is rotated in a reverse direction. The flapper 23 is switched by a not-shown driving unit and the recording material P is conveyed (switched back) in a reverse direction such that the recording material P reaches the duplex conveying roller pair 29. Thus, the recording material P is conveyed along the duplex conveying path 25 represented by a broken line in FIG. 1. As a result, it becomes possible to form a toner image on a side (a second side) of the recording material P opposite to the side (first side) on which the fixed toner image is already formed. The recording material P is conveyed by the duplex conveying roller pairs 26, 27, and 28 along the duplex conveying path 25 again to the registration roller pair 18, and further conveyed to the secondary transfer nip at specific timing. At proper timing, a toner image formed on the intermediate transfer belt 14 is transferred to the second side of the recording material P. The recording material P is again conveyed to the fixing apparatus 21, and the toner image on the second side of the recording material P is fused and fixed. The recording material P is then discharged by the discharge roller pair 32 to the tray 31, and thus the process of forming images on both sides is completed.

Density Sensor

The density sensor 38 is disposed at a location downstream from the image forming units 100 such that the density sensor 38 opposes the roller 19 via the intermediate transfer belt 14. The density sensor 38 functions as a unit for detecting the density of a developer image. More specifically, the density sensor 38 detects the density of a detection image T (see FIG. 2A) formed on the intermediate transfer belt 14. The position of the density sensor 38 is determined with respect to the roller 19 such that the relative position and the relative distance with respect to the roller 19 are maintained.

Figure 2A:
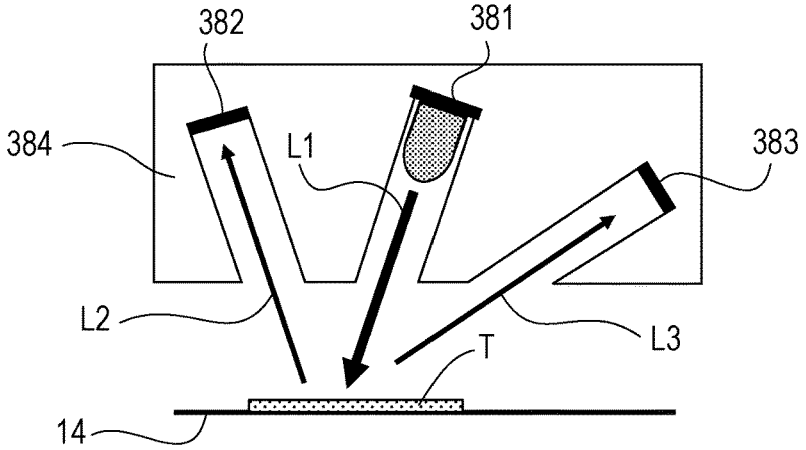
FIG. 2A is a schematic diagram illustrating a configuration of a density sensor according to one of first to third embodiments.

FIG. 2A illustrates a configuration of the density sensor 38. The density sensor 38 includes, as shown in FIG. 2A, a light emitting element 381 such as an LED, photodetectors 382 and 383 each may be for example a photodiode, a cadmium sulfide (CdS) cell, or the like, and a holder 384. The photodetector 382 is disposed such that it is allowed to detect specular reflection light L2 reflected at the surface of the intermediate transfer belt 14 at the same angle as the incidence angle of illumination light L1. On the other hand, the photodetector 382 is disposed such that it is allowed to detect diffused reflection light L3 reflected at the surface of the intermediate transfer belt 14 or at the surface of the detection image T on the intermediate transfer belt 14. The density sensor 38 emits the illumination light L1 from the light emitting element such that the illumination light L1 strikes the detection image T formed on the intermediate transfer belt 14. Reflected light L2 and reflected light L3 from the detection image T are detected by the photodetectors 382 and 383, and signals corresponding to the intensities of the respective received reflected light L2 and reflected light L3 are output. The CPU 34 calculates the density of the toner image formed on intermediate transfer belt 14 from the signals output from the density sensor 38.

The density sensor 38 is usually used to control the density of a toner image of each of colors Y, M, C, and Bk formed on the intermediate transfer belt 14. That is, detection images T are formed using toner of respective colors according to a plurality of pieces of image data. The resultant these toner images are detected by the density sensor 38 and a relationship between the image data and the density is determined for each color. The CPU 34 adjusts the LUT of the gamma correction unit 106 based on the relationship between the image data and the density. By adjusting the LUT of the gamma correction unit 106 in the above-described manner, it becomes possible to properly control the toner bearing amount for the toner image on the intermediate transfer belt 14 according to the image data in the image forming process.

Color Sensor

The color sensor 24 functioning as a color measurement unit is disposed along the duplex conveying path 25 and is configured to detect the detection image 248 (see FIG. 2B) fixed on the recording material P switched back by the discharge roller pair 32 and acquire values of tint (hereinafter such values will be referred to as color information). Although in the example shown in FIG. 1, the color sensor 24 is disposed so as to detect a central part of the recording material P, the position thereof is not limited to this example. For example, the color sensor 24 may be disposed to detect a part other than the central part. Furthermore, the number of the color sensors 24 is not limited to one, but a plurality of color sensors 24 may be disposed.

Figure 2B:
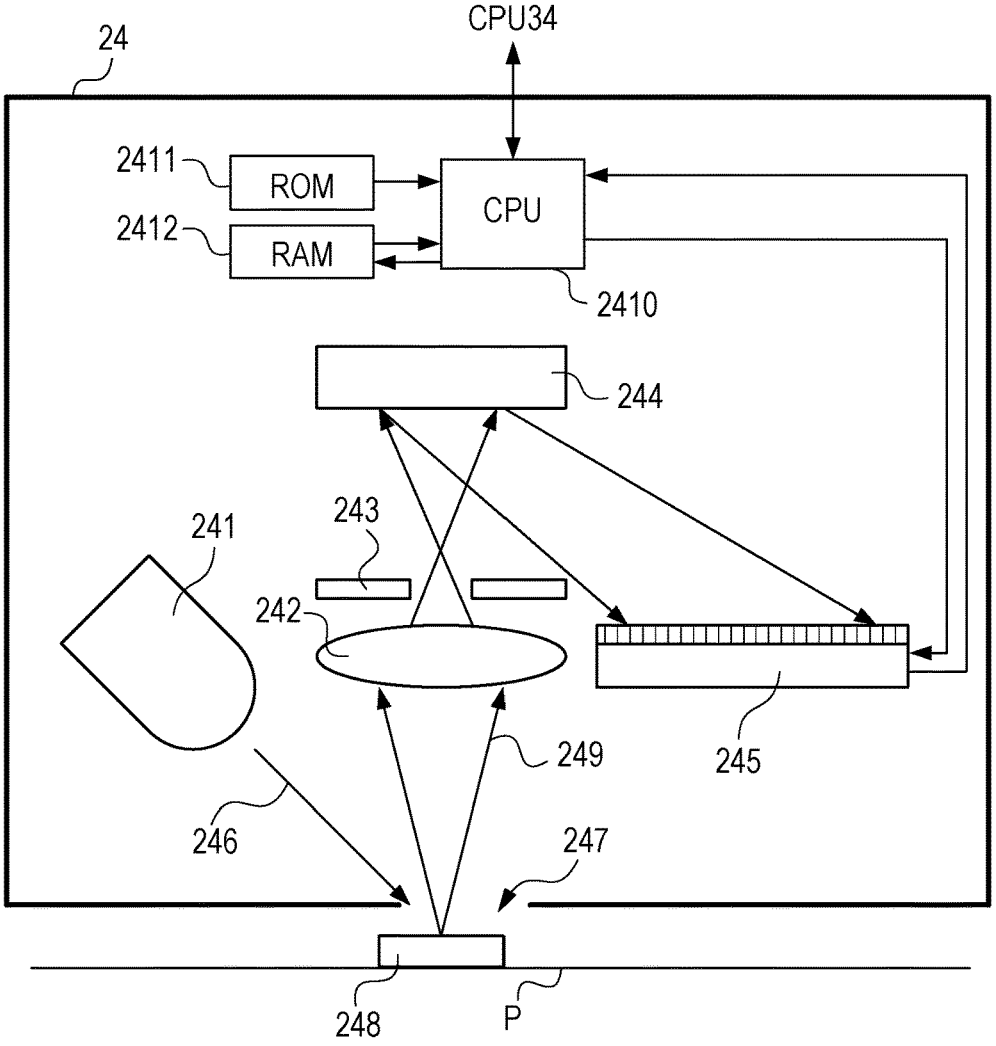
FIG. 2B is a schematic diagram illustrating a configuration of a color sensor.

FIG. 2B schematically illustrates a configuration of the color sensor 24 which is a spectrophotometer type color measurement unit. The color sensor 24 includes a white light source 241 configured to emit light with a wavelength distribution covering a whole visible range, a condensing lens 242, a slit 243, a diffraction grating 244, and a line sensor 245 including a plurality of photodetectors. The color sensor 24 also includes a CPU 2410 configured to control the color sensor 24 and perform various calculations. The color sensor 24 further includes a ROM 2411 which is a read-only memory in which a program used by the CPU 2410 in performing control and various kinds of data necessary in calculations are stored, and a RAM 2412 which a readable and writable memory used as a work area in data processing.

Light 246 emitted from the white light source 241 passes through an opening 247 and is incident at an angle of about 45° on the detection image 248 which is a color measurement target formed on the recording material P. The light is reflected as scattered light 249 depending on a light absorption characteristic of the detection image 248. Part of the scattered light 249 passes through the slit 243 via the condensing lens 242 and is incident on the diffraction grating 244 and is dispersed thereby. The dispersed light is incident on the line sensor 245, which outputs signals corresponding to intensities of incident light from the respective photodetectors. The signals output from the line sensor 245 are input to the CPU 2410. The CPU 2410 performs a particular calculation on the signals output from the respective photodetectors of the line sensor 245 thereby determining a spectral reflectivity at intervals of 10 nm in a range from 380 nm to 730 nm. The CPU 2410 may further perform a calculation on the spectral reflectivity to determine a chromaticity value in an XYZ (CIE/XYZ) or L*a*b* (CIE/L*a*b*) color space defined by CIE (the International Commission on Illumination). The color sensor 24 is capable of communicating with the CPU 34 in the engine unit 502, and the CPU 34 is capable of receiving the chromaticity value L*a*b* calculated by the color sensor 24. Alternatively, the signals output from the line sensor 245 may be input to the CPU 34, which may determine the spectral reflectivity and/or the chromaticity value.

Figure 3A:
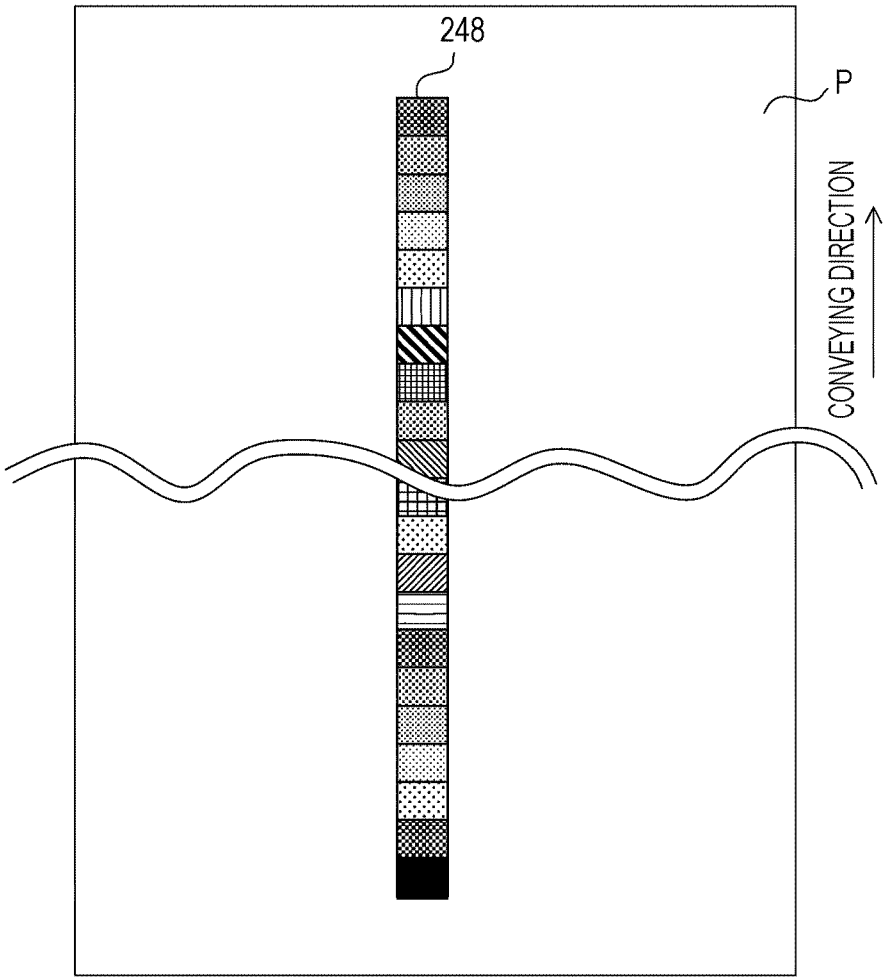
FIG. 3A is a diagram illustrating a detection image according to first or second embodiment.

The color sensor 24 is usually used to adjust a tint of an image formed on a recording material P by the image forming apparatus 500. FIG. 3A illustrates an example of the detection image 248 formed on a recording material P as a color measurement target image to be detected by the color sensor 24. After the detection image 248 including various colors is formed and fixed on the recording material P as shown in FIG. 3A, the CPU 34 acquires chromaticity values L*a*b* of the respective colors using the color sensor 24. Note that toner images included in the detection image 248 are also referred to as patches. The CPU 34 determines, using the color sensor 24, a correspondence between the chromaticity value L*a*b* of each patch and image data used to form the path. Based on the determined correspondence, the CPU 34 alters the color table in the color conversion unit 105 to make it possible to form an image having a particular tint.

Optimizing Toner Bearing Amount

Figure 3B:
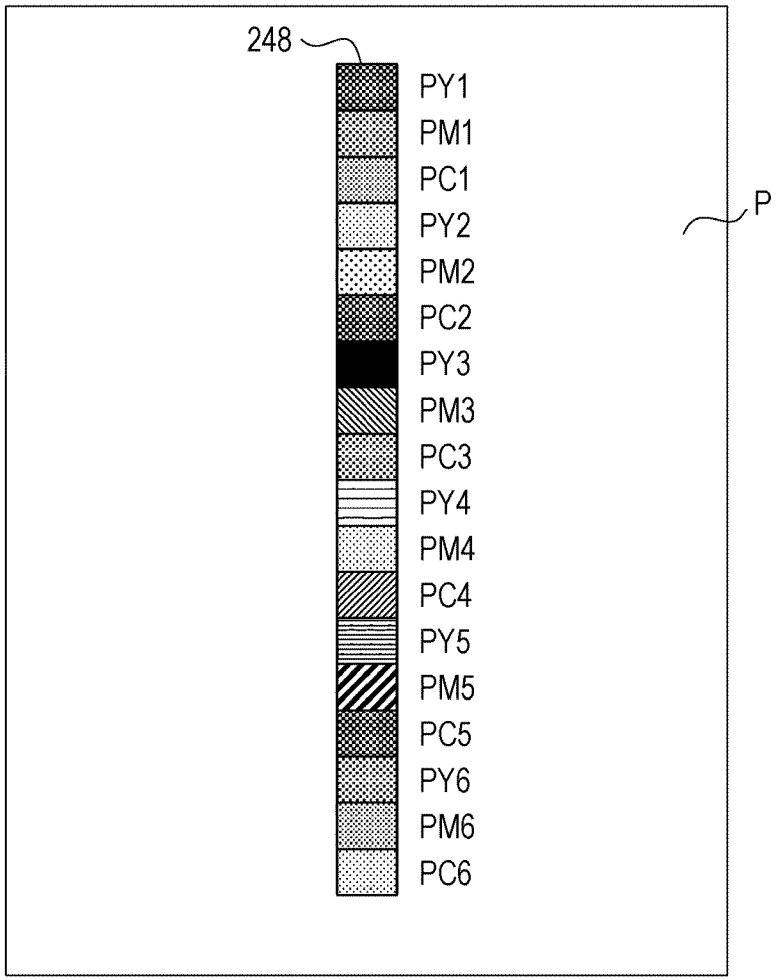
FIG. 3B is a diagram illustrating a patch image.
Figure 4:
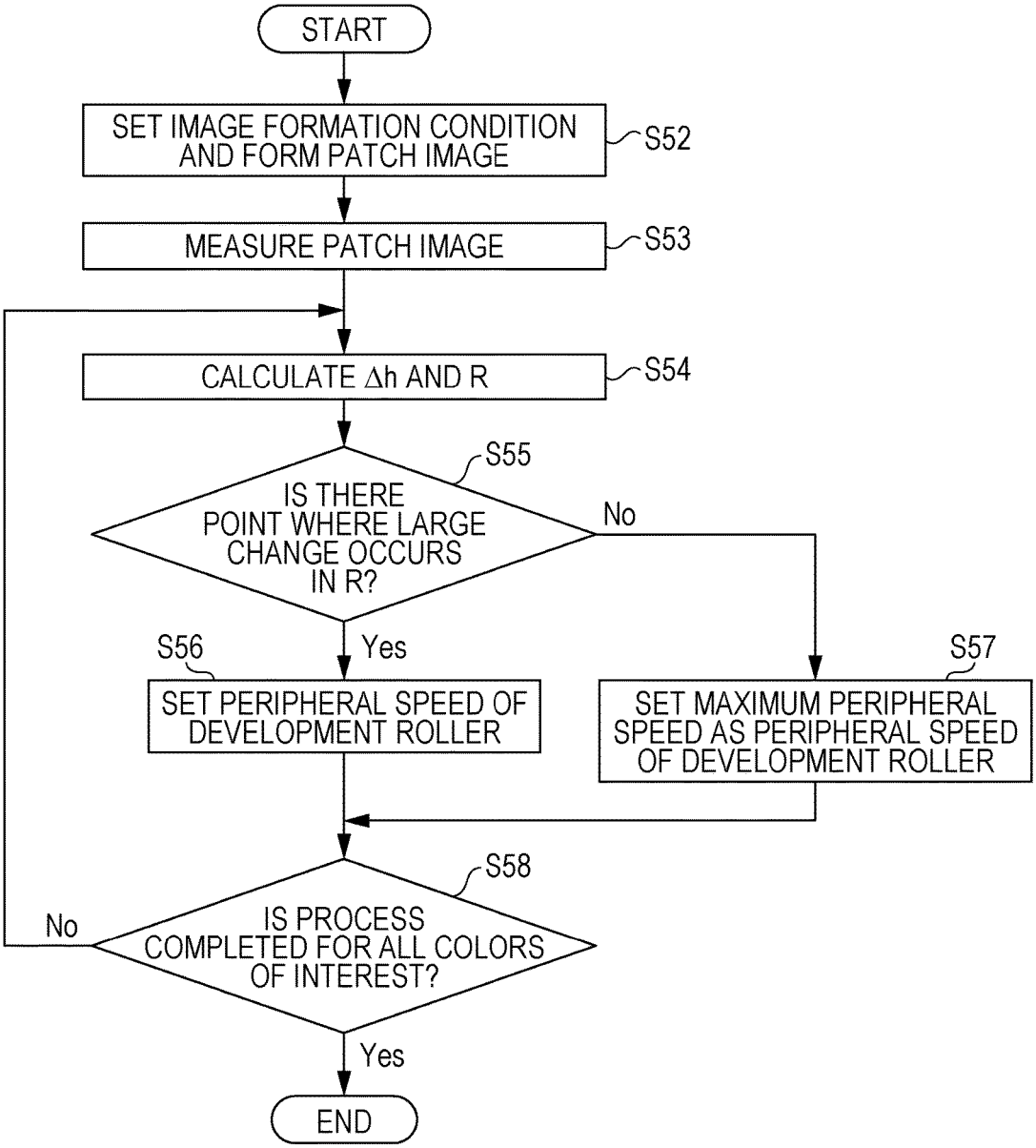
FIG. 4 is a flow chart of a process of optimizing a toner bearing amount according to the first embodiment.

FIG. 4 is a flow chart illustrating a process of optimizing a toner bearing amount according to the present embodiment. When the image forming apparatus 500 detects an occurrence of a particular event such as a change in the number of sheets to be printed, a change in environment, replacement of the process cartridge including the drum unit 10 and the development unit 8, or the like, the image forming apparatus 500 starts the process from step S52 to optimize the toner bearing amount. The number of sheets to be printed is managed by the CPU 34 using, for example, a counter. Note that the image forming apparatus 500 may include a sensor for detecting temperature or humidity, and the CPU 34 may detect an occurrence of a change in environment based on information provided by the sensor. The process cartridge may further include a memory such as a memory tag, and the CPU 34 may detect an occurrence of replacement of the process cartridge based on information stored in the memory. The optimization of the toner bearing amount is performed only for toner of Y, M, and C, excessive toner bearing amounts of which may cause a significant change in tint. In S52, the CPU 34 sets an image formation condition including various parameters such as voltage values used in an image forming process, and forms a patch image as the detection image 248 on the recording material P. FIG. 3B illustrates an example of the patch image formed in S52. The image of each patch included in the patch image shown in FIG. 3B is generated by the detection image generation unit 104 such that the image has a uniform density according to image data, for example, having a value of FFH. In FIG. 3B, for ease of understanding, patches PY1 to PC6 are represented in patterns different from each other. However, the patches PY1 to PC6 are all formed according to image data equally having a value of FFH. More specifically, patches PY1 to PY6 are formed using Y color toner, patches PM1 to PM6 are formed using M color toner, and patches PC1 to PC6 are formed using C color toner. In the present embodiment, a parameter that controls the toner bearing amount is the peripheral speed of the developing roller 5. Table 1 shown below represents the relative peripheral speed of each developing roller 5 employed in forming a patch with reference to the peripheral speed of the photosensitive drum 1.

TABLE 1

| | PY1 | PY2 | PY3 | PY4 | PY5 | PY6 |
|---|---|---|---|---|---|---|
| Y | 175% | 180% | 185% | 190% | 195% | 200% |
| | PM1 | PM2 | PM3 | PM4 | PM5 | PM6 |
| M | 175% | 180% | 185% | 190% | 195% | 200% |
| | PC1 | PC2 | PC3 | PC4 | PC5 | PC6 |
| C | 175% | 180% | 185% | 190% | 195% | 200% |

For example, as for Y-color patches, the same FFH image data is used and the relative peripheral speed of the developing roller 5Y with reference to the peripheral speed of the photosensitive drum 1Y is set to 175% for PY1, 180% for PY2, 185% for PY3, 190% for PY4, 195% for PY5, and 200% for PY6. To properly form each patch without being disturbed by an operation of switching the peripheral speed of the developing roller 5, it is needed to have an interval between adjacent patches of the same color. Therefore, in the present embodiment, the patch images are arranged in the order PY1→PM1→PC1→PY2 . . . as shown in FIG. 3B. As described above, when a plurality of patches are formed for the same color using various different peripheral speeds of the developing roller 5, the CPU 34 controls the image forming operation such that there is a time interval of a particular length between processes of forming the patches of the same color using different peripheral speeds.

In S53, the CPU 34 measures, using the color sensor 24, the patches PY1 to PY6, PM1 to PM6, and PC1 to PC6 formed on the recording material P. As described above, in the color sensor 24, the CPU 2410 determines the chromaticity value L*a*b* for each patch based on the measurement result of the patch and outputs the determined chromaticity value L*a*b* to the CPU 34. Thus, the CPU 34 acquires the chromaticity value L*a*b* for each patch from the color sensor 24. In S54, the CPU 34 calculates a hue angle Δh and a rate of change R for the chromaticity value L*a*b* of each of the patches PY1 to PY6, PM1 to PM6, and PC1 to PC6. The hue angle Δh may be determined according to formula (1) shown below.

$$\Delta h = \tan-1(b^*/a^*) \quad (1)$$

The hue angle Δh is an index of tint.

The rate of change R may be determined according to formula (2) shown below.

$$Rn = \{\Delta h(n) - \Delta h(n-1)\}/\Delta h(n-1) \quad (2)$$

where n corresponds to an index number of the patch (the number of patches formed). In the example shown in FIG. 3B, n takes a value from 1 to 6. Note that when n=1, the rate of change R is regarded as 0.00. The rate of change R is a rate of change of the hue angle Δh occurring when the peripheral speed of the developing roller 5 is changed as shown in Table 1. In Table 2 described below, although the rate of change R is negative except for 0.00, the rate of change R can be positive.

As an example, Table 2 shows a hue angle Δh and a rate of change R calculated for each of the C-color patches PC1 to PC6.

TABLE 2

| | PC1 | PC2 | PC3 | PC4 | PC5 | PC6 |
|---|---|---|---|---|---|---|
| Δh | −118.47 | −118.60 | −118.60 | −118.60 | −113.66 | −112.73 |
| R | 0.00 | 0.00 | 0.00 | 0.00 | −0.04 | −0.01 |

For example, the hue angle Δh and the rate of change R for the patch PC5 are respectively −113.66 and −0.04. As shown in Table 2, the patch PC5 has a large rate of change R (the absolute value thereof), which means that a large change in the hue angle Δh occurs at the patch PC5 and thus a large change occurs in tint.

In S55, the CPU 34 determines whether there is a patch (hereinafter also referred to as a point) where a large change occurs in the rate of change R calculated in S54. In this determination process, for example, a threshold value may be defined, and in a case where the rate of change R is larger than the threshold value, the CPU 34 may determine that a large change rate of change R occurs. An acceptable range of the change in tint varies depending on the image forming apparatus, and thus the threshold value is set to a value optimum for each image forming apparatus. In a case where the CPU 34 determines in S55 that there is a point where a large change in rate of change R occurs, the CPU 34 advances the process to S56. However, in a case where the CPU 34 determines in S55 that there is no point where a large change in rate of change R occurs, the CPU 34 advances the process to S57. In S56, the CPU 34 determines that an optimum toner bearing amount is a toner bearing amount for a patch immediately before the patch at which a change in tint occurs. For example, in the case shown in Table 2, the CPU 34 determines that the optimum toner bearing amount is that for the patch PC4 immediately before the patch PC5 at which a change in tint occurs. The CPU 34 sets the optimum peripheral speed ratio such that the peripheral speed ratio, relative to the peripheral speed of the photosensitive drum 1, of the developing roller 5 set to the patch at which the toner bearing amount is optimum is employed as the optimum peripheral speed ratio for the developing roller 5 of color of interest. For example, in the case shown in Table 2, the CPU 34 sets the optimum peripheral speed ratio such that the peripheral speed ratio of 190%, relative to the peripheral speed of the developing roller 5C, set for the developing roller 5C for the patch PC4 (see Table 1) is employed as the optimum peripheral speed ratio for the C-color developing roller 5C.

In the present embodiment, the CPU 34 selects, as the optimum toner bearing amount, the toner bearing amount of the patch immediately before the patch at which a large change in rate of change R occurs. This point corresponds to a point α in FIG. 7B. However, alternatively, it may be allowed to select, as the optimum toner bearing amount, a toner bearing amount of another patch located two or more points before a patch at which a large change in rate of change R occurs. That is, the optimum toner bearing amount is obtained at points lying on the solid line of the hue angle θ1 in FIG. 7B, and the point at which the toner bearing amount is optimum is not limited to the point immediately before the point at which a large change in toner bearing amount occurs. In a case where it is desired to employ as large a toner bearing amount as possible within a range acceptable for the optimum toner bearing amount, it is desirable to select a point, such as a point α in FIG. 7B, immediately before a point at which a large change in rate of change R occurs. In S58, the CPU 34 determines whether the optimization process is completed for all colors of interest. In a case where it is determined that the optimization process is not yet completed for all colors, the processing flow returns to S54 to optimize the peripheral speed ratio for another color (for example, Y or M). In a case where the CPU 34 determines in S58 that the optimization process is completed for all colors of interest, the process of optimizing the toner bearing amount is ended. In S57 the CPU 34 sets the peripheral speed ratio such that a greatest value of all peripheral speed ratios used in forming the patches is selected as the peripheral speed ratio for the developing roller 5 of the color of interest, and the CPU 34 advances the processing flow to S58. For example, in the case shown in Table 1, when there is no patch at which a large change in tint occurs, a greatest peripheral speed ratio, that is, 200% is selected as the peripheral speed ratio for the Y-color developing roller 5Y. However, alternatively, in the case where there is no patch at which a large change in tint occurs, a value smaller than or equal to the greatest peripheral speed may be employed as the peripheral speed for the developing roller 5.

As described above, the CPU 34 detects a change greater than or equal to a predetermined value in the tint value from all tint values of a plurality of detection images, and, based on the tint value where the change is observed, the CPU 34 sets parameters for use in forming an image. More specifically, based on color information representing the color measurement result provided by the color sensor 24, the CPU 34 detects, from a plurality of patches (for example, PY1 to PC6), a patch (for example, PC5) at which a change in color information occurs. Based on the detected patch (for example, PC5), the CPU 34 selects a particular patch (for example, PC4) from the plurality of patches. The CPU 34 sets a parameter such that a parameter value (for example, 190%) used in forming the selected patch (for example, PC4) is employed as a parameter value for use in forming an image. Optimizing the toner bearing amount in the above-described manner makes it possible to more properly make a tone correction using the density sensor 38 to obtain an image having high quality in terms of tint, density, and tone. Using the parameter that provides the optimized toner bearing amount, a following image forming process may be performed. Note that in a case where it is known that no change in tint occurs for a particular color regardless of the toner bearing amount, it is not necessary to perform, for such a color, the process of optimizing the toner bearing amount shown in FIG. 4.

Figure 7A:
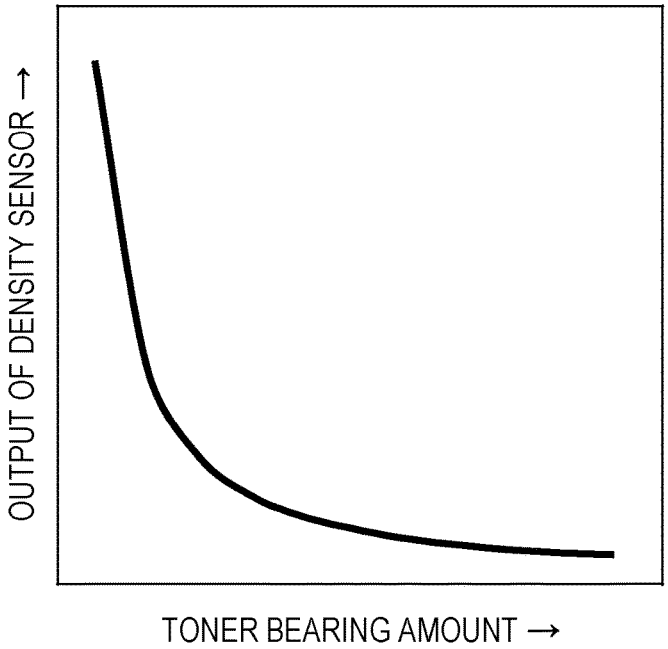
FIG. 7A is a graph showing an example of a relationship between an output of a density sensor and a toner bearing amount according to a conventional technique.
Figure 7B:
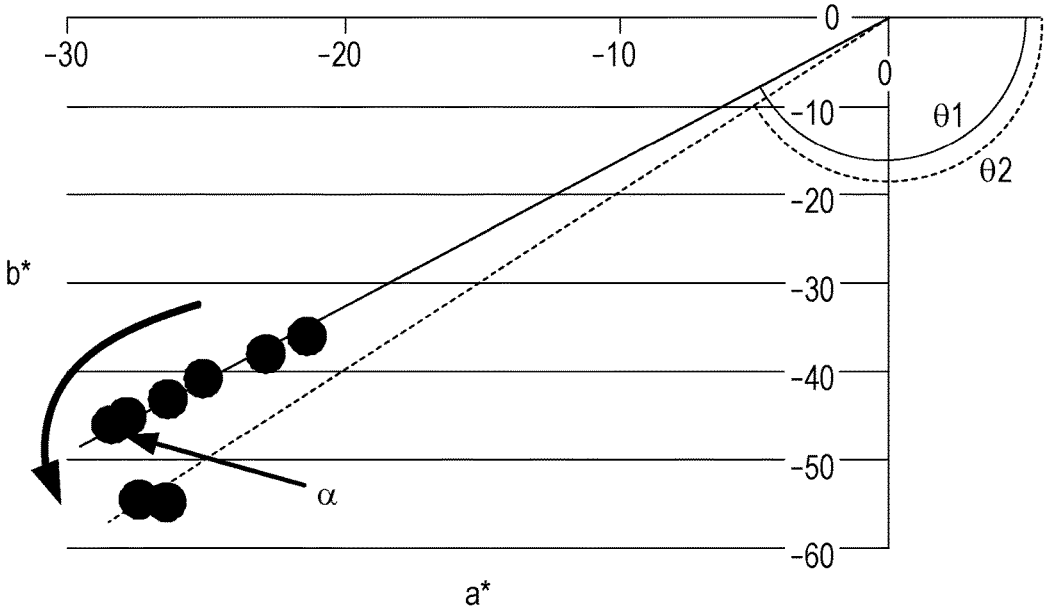
FIG. 7B is a diagram illustrating a plot of chromaticity on an a*b* plane for various toner bearing amounts.

In the present embodiment, as described above, based on the rate of change R of the hue angle Δh, the peripheral speed ratio of the developing roller 5 with reference to the peripheral speed of the photosensitive drum 1 is set such that the toner bearing amount is optimally set, for example, at point α in FIG. 7B, within a range in which no large change occurs in tint. Not that in a case where it is desired to achieve a toner bearing amount greater than is possible to achieve by adjusting the peripheral speed ratio of the developing roller 5, the charged potential of the photosensitive drum 1 and/or the amount of exposure light of the exposure apparatus 11 may be changed to change the latent image contrast. The latent image contrast is determined by the potential of the photosensitive drum 1 charged by the charging roller 2, and the amount of exposure light provided by the exposure apparatus 11. Thus, it may be allowed to add a plurality of latent image contrast levels to the patch forming condition in forming patch images in the process at S52 shown in FIG. 4. Instead, only a parameter associated with latent image contrast may be employed in controlling the toner bearing amount.

According to the present embodiment, as described above, it is possible to set the optimum toner bearing amount within a range in which no significant change in tint occurs.

Second Embodiment

A second embodiment is described below. Note that a description is omitted as to similar elements in configuration or similar processing steps to those of the image forming apparatus 500 or the like according to the first embodiment. An increase in the toner bearing amount may influence a fixing process and may result in an increase in consumption of toner. Therefore, in a normal print mode, the toner bearing amount for the maximum density is set taking into account the influence on the fixing process and the consumption of toner. In recent years, some color image forming apparatuses have been available which have a wide color gamut mode in which a larger toner bearing amount than a usual maximum amount is allowed to achieve a wider color reproduction range. In some color image forming apparatuses, unlike the first embodiment, driving units are shared among two or more developing rollers 5 to reduce the cost. In the second embodiment, the developing rollers 5Y, 5M, 5C, and 5K are driven by a common driving unit. In this configuration, unlike the first embodiment, it is not allowed to set the peripheral speed of the developing roller 5 individually for respectively colors. The present embodiment provides a technique of optimizing the toner bearing amount in a color image forming apparatus having a wide color gamut mode and having a driving unit shared to drive developing rollers 5Y, 5M, and 5C of Y, M, and C colors.

Optimizing Toner Bearing Amount

Figure 5:
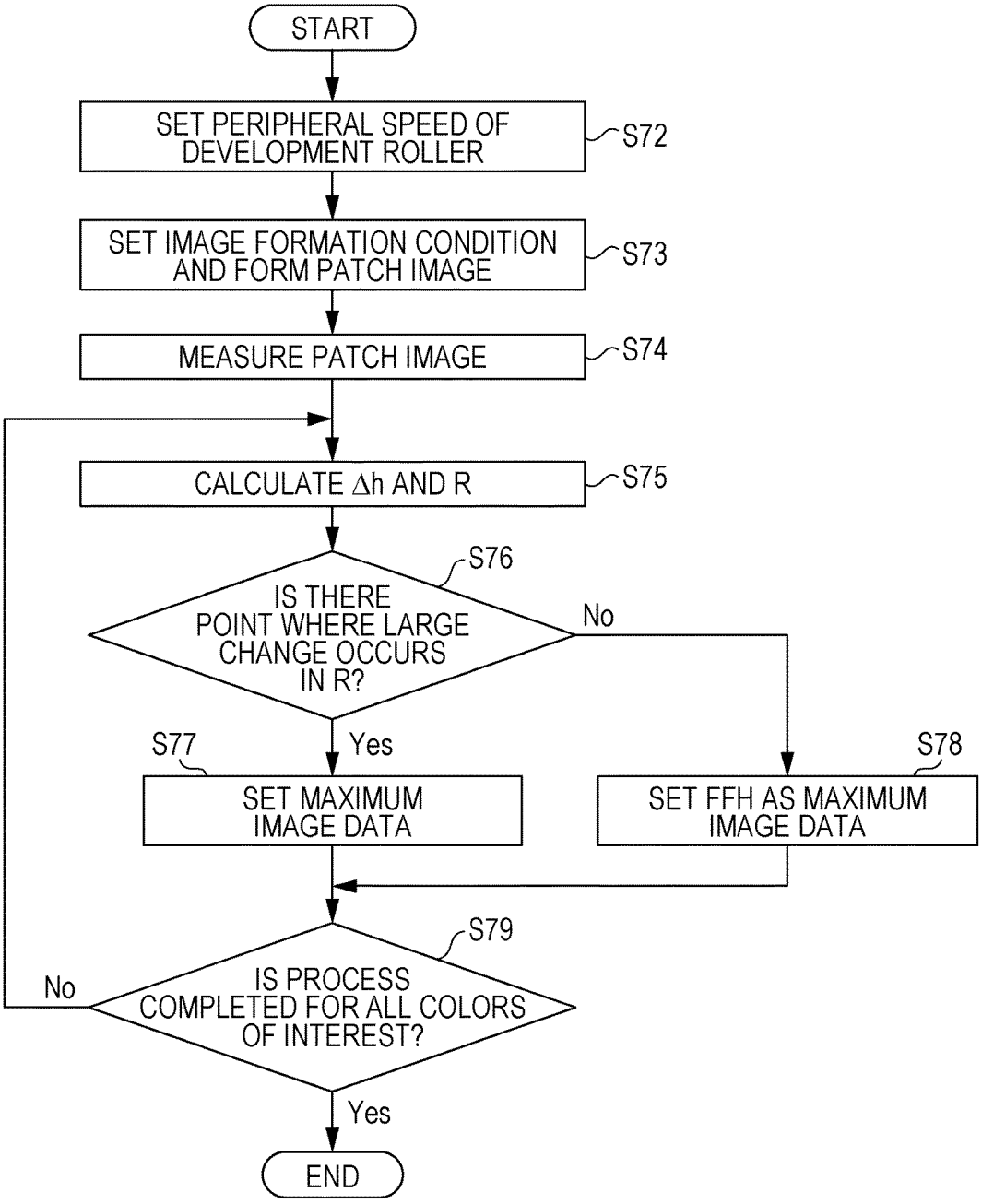
FIG. 5 is a flow chart of a process of optimizing a toner bearing amount according to the second embodiment.

FIG. 5 is a flow chart illustrating a process of optimizing a toner bearing amount according to the present embodiment. When the CPU 34 detects an occurrence of a particular event such as a change in the number of sheets to be printed, a change in environment, replacement of a process cartridge, or the like, the CPU 34 starts a process from step S72 to optimize the toner bearing amount in the wide color gamut mode. In S72, the CPU 34 sets the peripheral speed of the developing roller 5. In this setting, the peripheral speeds of the developing rollers 5Y, 5M, and 5C of Y, M, and C colors are set depending on the situation in which the development units 8Y, 8M, and 8C are used and the environment in which the image forming apparatus 500 is installed. The peripheral speeds of the developing rollers 5Y, 5M, and 5C of Y, M, and C colors are set such that a toner bearing amount is greater than or equal to a predetermined value even for a development unit 8 which needs the least toner bearing amount of toner bearing amounts of all development units 8.

In S73, the CPU 34 sets the image forming condition including various voltages and out parameters for the wide color gamut mode, and forms a patch image similar to that shown in FIG. 3B on the recording material P. In the present embodiment, image data gives a parameter that controls the toner bearing amount. Table 3 shows image data values used in forming patches.

TABLE 3

| | PY1 | PY2 | PY3 | PY4 | PY5 | PY6 |
|---|---|---|---|---|---|---|
| Y | EBH | EFH | F3H | F7H | FBH | FFH |
| | PM1 | PM2 | PM3 | PM4 | PM5 | PM6 |
| M | EBH | EFH | F3H | F7H | FBH | FFH |
| | PC1 | PC2 | PC3 | PC4 | PC5 | PC6 |
| C | EBH | EFH | F3H | F7H | FBH | FFH |

For example, for Y-color patches, values of image data are set such that EBH is used for PY1, EFH is used for PY2, F3H is used for PY3, F7H is used for PY4, FBH is used for PY5, and FFH is used for PY6. Note that in the present embodiment, it takes no time to switch parameters unlike the first embodiment in which it takes a time to switch the peripheral speeds of the developing rollers 5. Therefore, in the present embodiment, there is no particular restriction on the order of forming patches in the patch image on the recording material P, and thus, for example, PY1 to PY6 may be located in successive positions. In the present embodiment, as described above, when the CPU 34 forms a plurality of patches while changing the image data value, the CPU 34 may form patches for the same color but for different image data values such that they are formed continuously or may be formed in particular time intervals.

In S74, the CPU 34 measures, using the color sensor 24, patches PY1 to PY6, PM1 to PM6, and PC1 to PC6 formed on the recording material P. As a result, the CPU 34 acquires chromaticity values L*a*b* for the respective patches. In S75, the CPU 34 calculates a hue angle Δh according to formula (1) and a rate of change R according to formula (2) for the chromaticity value of each of the patches PY1 to PY6, PM1 to PM6, and PC1 to PC6 in a similar manner to the first embodiment. In S76, as in the first embodiment, the CPU 34 determines whether there is a point at which a large change in the rate of change R occurs, that is, whether there is a patch at which a large change in the hue angle Δh occurs. In a case where the CPU 34 determines in S76 that there is a point where a large change in rate of change R occurs, the CPU 34 advances the processing flow to S77. However, in a case where the CPU 34 determines in S76 that there is no point where a large change in rate of change R occurs, the CPU 34 advances the processing flow to S78.

In S77, the CPU 34 makes a setting such that an image data value used in forming a patch, immediately before the patch at which the large change in rate of change R is detected, is employed as a maximum image data value used in the image forming apparatus 500. For example, when the hue angle Δh and the rate of change R are calculated in S75 as shown in Table 2, then the setting for C color is performed as follows. As for C color, a large change in rate of change R occurs at the patch PC5. Thus, in S77, based on the result of the calculation in S75 and the information described in Table 3, the CPU 34 selects an image data value F7H of the patch PC4 immediately before the patch PC5 and sets the selected value F7H as the maximum image data value used in the image forming apparatus 500. On the other hand, in S78, the CPU 34 sets an image data value FFH as the maximum image data value used in the image forming apparatus 500, and the CPU 34 advances the processing flow to S79. Note that as described above, the image data is bit data. In S78 described above, the CPU 34 selects a greatest value that can be expressed in bit data (in the case of 8-bit data, FFH), and sets this greatest value as the maximum image data value. Note that in a case where there is no patch at which a change in tint occurs, a value smaller than the greatest image data value may be employed as the maximum allowable image data value. The process in S79 is similar to the process in S58, and thus a description thereof is omitted. In the tone correction process using the density sensor 38, the CPU 34 sets the LUT of the gamma correction unit 106 such that the range up to the maximum image data value set in S77 or S78 is fully used in the LUT.

According to the present embodiment, as described above, even in the image forming apparatus in which the driving unit is shared to drive the developing rollers 5, it is possible to set the maximum allowable image data value based on the rate of change R of the hue angle Δh. Thus, according to the present embodiment, it is possible to set the optimum toner bearing amount within the range in which no significant change in tint occurs. Note that the technique according to the first embodiment may be applied to an image forming apparatus in which developing rollers are driven independently as is the case in the first embodiment.

Third Embodiment

A third embodiment is described below. Note that a description is omitted as to similar elements in configuration or similar processing steps to those of the image forming apparatus 500 or the like according to the first embodiment. The third embodiment provides a technique of optimizing the toner bearing amount in a color image forming apparatus in which a driving unit is shared to drive the developing rollers 5Y, 5M, and 5C of Y, M, and C colors. Note that the technique according to the third embodiment may be applied to the control of the optimum toner bearing amount in the wide color gamut mode described above in the second embodiment.

Optimizing Toner Bearing Amount

Figure 6:
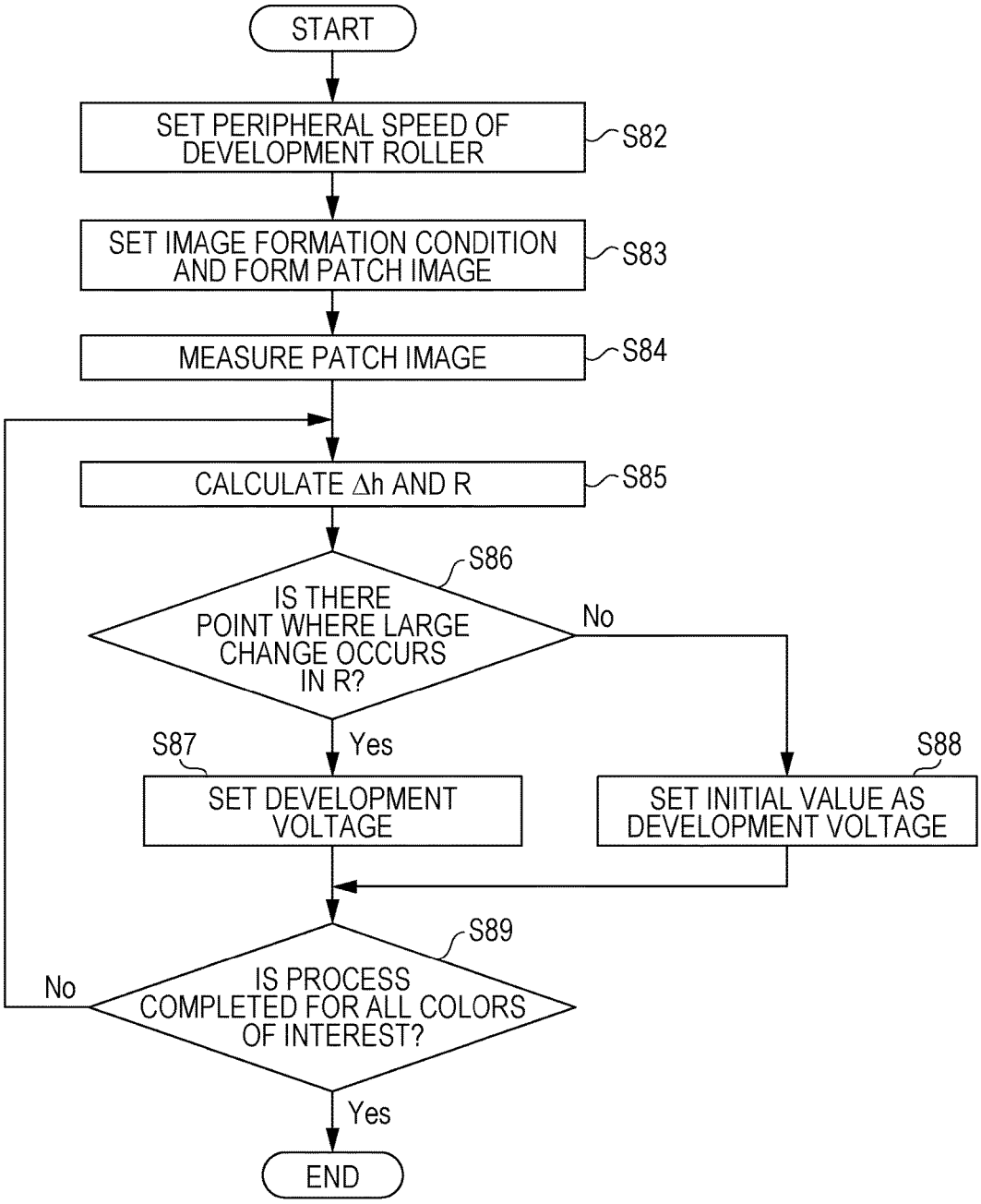
FIG. 6 is a flow chart of a process of optimizing a toner bearing amount according to the third embodiment.

FIG. 6 is a flow chart illustrating a process of optimizing a toner bearing amount according to the present embodiment. When the CPU 34 detects an occurrence of a particular event such as a change in the number of sheets to be printed, a change in environment, replacement of a process cartridge, or the like, the CPU 34 starts the process from step S82 to optimize the toner bearing amount. In S82, the CPU 34 sets the peripheral speeds of the developing rollers 5Y, 5M, and 5C of Y, M, and C colors as follows. Depending on the situation in which the development units 8Y, 8M, and 8C are used and the environment in which the image forming apparatus 500 is installed, the CPU 34 makes the setting such that a toner bearing amount is greater than or equal to a predetermined value even for a development unit 8 which needs the least toner bearing amount of toner bearing amounts of all development units 8. In S83, the CPU 34 sets the image formation condition including various parameters such as voltage values. After the CPU 34 sets the image formation condition, the CPU 34 forms a patch image similar to that shown in FIG. 3B on the recording material P. More specifically, the image including a plurality of patches is formed by the detection image generation unit 104 according to the same image data value, for example, FFH such that patches PY1 to PY6 are formed in Y color, patches PM1 to PM6 are formed in M color, and patches PC1 to PC6 are formed in C color. In the present embodiment, the parameter that controls the toner bearing amount is a development voltage. Table 4 shows development voltage values used in forming the respective patches. The values in Table 4 describe how much the development voltage is to be changed from the initial development voltage set in the image forming apparatus 500, that is, Table 4 indicates values that are to be added to or subtracted from the initial development voltage. In the present embodiment, the development voltage is changed from the preset intimal value. In the present embodiment, the image forming apparatus includes a unit (not shown) for applying the development voltage to the developing rollers 5. Note that the initial development voltage is set in advance.

TABLE 4

| | PY1 | PY2 | PY3 | PY4 | PY5 | PY6 |
|---|---|---|---|---|---|---|
| Y | +10 V | +5 V | 0 V | −5 V | −10 V | −15 V |
| | PM1 | PM2 | PM3 | PM4 | PM5 | PM6 |
| M | +10 V | +5 V | 0 V | −5 V | −10 V | −15 V |

TABLE 4-continued

| | PC1 | PC2 | PC3 | PC4 | PC5 | PC6 |
|---|---|---|---|---|---|---|
| C | +10 V | +5 V | 0 V | −5 V | −10 V | −15 V |

For example, for Y-color patches, the same image data value, that is, FFH is used, but the development voltages are changed by particular amounts such that +10 V for PY1, +5 V for PY2, 0 V for PY3, −5 V for PY4, −10 V for PY5, and −15 V for PY6. Note that in the present embodiment, as described above, the development voltage is changed in forming the patches. Therefore, in the present embodiment, as in the first embodiment, the order of forming the patches in the patch image on the recording material P is determined taking into account the time needed to switch the development voltage and the time needed for the changed development voltage to attain a stable state. Therefore, it is needed to have an interval between adjacent patches of the same color. More specifically, in the present embodiment, the CPU 34 forms a plurality of patches while changing the development voltage such that a time interval of a particular length is provided between patches which are equal in color and different in development voltage.

In S84, the CPU 34 measures, using the color sensor 24, the patches PY1 to PY6, PM1 to PM6, and PC1 to PC6 formed on the recording material P. As a result, the CPU 34 acquires the chromaticity value L*a*b* for each patch calculated by the color sensor 24. In S85, the CPU 34 calculates the hue angle Δh and the rate of change R for the chromaticity value L*a*b* of each of the patches PY1 to PY6, PM1 to PM6, and PC1 to PC6 in a similar manner as in the first embodiment. In S86, as in the first embodiment, the CPU 34 determines, for each color, whether there is a point where a large change in the rate of change R occurs, that is, whether there is a patch at which a large change in the hue angle Δh occurs. In a case where the CPU 34 determines in S86 that there is a point where a large change in the rate of change R occurs, the CPU 34 advances the processing flow to S87. However, in a case where the CPU 34 determines in S55 that there is no point where a large change in rate of change R occurs, the CPU 34 advances the processing flow to S88.

In S87, the CPU 34 makes a setting such that a development voltage used in forming a patch, immediately before the patch at which the large change in rate of change R is detected, is employed as a development voltage used in the image forming apparatus 500. For example, when the hue angle Δh and the rate of change R are calculated in S85 as shown in Table 2, then the setting for C color is performed as follows. As for C color, a large change in rate of change R occurs at the patch PC5. Thus, in S87, based on the result of the calculation in S85 and the information described in Table 4, the CPU 34 sets the development voltage such that an amount of change in voltage, that is, −5V, employed in forming a patch PC4, which is a patch immediately before the patch PC5, is added to the initial development voltage, and the result is set as the development voltage used in the image forming apparatus 500. On the other hand, in S88, the CPU 34 sets the initial development voltage as the development voltage used in the image forming apparatus 500, the CPU 34 advances the processing flow to S89. Note that in a case where there is no patch at which a large change in tint occurs, a voltage within the range in which the development voltage is changed (in the example shown in Table 4, from the initial development voltage minus 15V to the initial development voltage plus 10 V) may be employed as the development voltage used in forming images. The process in S89 is similar to the process in S58 described above with reference to FIG. 4, and thus a description thereof is omitted.

In the present embodiment, as described above, it is possible to set the optimum toner bearing amount within a range in which no significant change in tint occurs. According to the present embodiment, as described above, even in the image forming apparatus in which the driving unit is shared to drive the developing rollers, by setting the development voltage based on the change in hue angle Δh, it is possible to set the optimum toner bearing amount within a range in which no significant change in tint occurs. Note that the technique according to the first embodiment may be applied to an image forming apparatus in which developing rollers are driven independently as is the case in the first embodiment.

Modifications

The first to third embodiments are described above only by way of example, and many modifications are possible. Some examples of modifications are described below. It assumed in the above embodiments that the image forming apparatus 500 is of the tandem type, but the image forming apparatus is not limited to the tandem type. For example, a rotary type may be employed. Alternatively, the image forming apparatus 500 may be of a multiple-transfer type configured such that toner images formed on a plurality of photosensitive drums are sequentially transferred to a recording material conveying by a recording material conveying member thereby forming a color image.

In the embodiments described above, it is assumed by way of example that the color sensor 24 is of the spectrophotometer type. Alternatively, for example, the color sensor 24 may be of an RGB filter type.

In the embodiments described above, the printing rate of the detection image formed in the process of optimizing the toner bearing amount and the combination of peripheral speed ratios used in forming the detection image are merely examples, and other values may be employed for the printing rate or the combination of the peripheral speed ratios.

In the embodiments described above, single-color patches are formed on the recording material in the process of optimizing the toner bearing amount. Alternatively, in the process of optimizing the toner bearing amount, patches may be of two or more colors formed by superimposing a plurality of pieces of toner.

In the embodiments described above, it is assumed by way of example that the color sensor 24 is located in the duplex conveying path. However, the color sensor 24 may be disposed at any other proper location in the image forming apparatus as long as the location allows it to detect the detection image on the fixed recording material P. Note that the location of the color sensor 24 is not limited to the inside of the image forming apparatus, but the color sensor 24 may be located outside the image forming apparatus and may be connected to the image forming apparatus via a computer or the like. Instead of using the color sensor, a document reader unit of a copying machine may be used to read the detection image.

The present disclosure may be applied not only to the image forming apparatus using single-component toner but also to an image forming apparatus using two-component toner (two-component developer) including toner and a carrier. In this case, a mixing ratio between the toner and the carrier may be used as a parameter (to be set) used to control the toner bearing amount.

Also in the modifications described above, it is possible to set the optimum toner bearing amount within a range in which no significant change in tint occurs.

In the present disclosure, as described above, it is possible to set the optimum toner bearing amount within a range in which no significant change in tint occurs.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-126720 filed Jun. 27, 2016, which is hereby incorporated by reference herein in its entirety.

What is claimed is:

1. An image forming apparatus comprising:

a plurality of forming units corresponding to respective colors, each forming unit including a photosensitive member on which a latent image is formed and a developing unit configured to develop, using a developer, the latent image formed on the photosensitive member thereby forming a developer image;

a control unit configured to change a parameter used to control a developer bearing amount and control the forming units to form a plurality of detection images according to different parameters; and a color measurement unit configured to measure a plurality of values of tint according to the plurality of detection images formed by the forming units, wherein the control unit is configured to calculate changes of tint based on the plurality of values of tint and to determine if a large change of tint occurs, the large change exceeding a predetermined value or being equal to the predetermined value, and wherein the control unit configured to set an image forming parameter, used to control a developer bearing amount, based on the parameter for the detection images by which no large change occurs in tint.

2. The image forming apparatus according to claim 1, wherein the control unit is configured to specify a specific detection image corresponding to the value of tint showing the change in tint greater than or equal to the predetermined amount, and setting the image forming parameter based on the specific detection image.

3. The image forming apparatus according to claim 1, wherein the plurality of developing units are driven independently of each other, and the parameter is a peripheral speed of each developing unit.

4. The image forming apparatus according to claim 3, wherein the control unit is configured to use, such that in a case where the plurality of detection images are formed for different peripheral speeds of the developing unit, fixed image data in forming the plurality of detection images.

5. The image forming apparatus according to claim 3, wherein the control unit is configured to form, in a case where the plurality of detection images are formed with different peripheral speeds of the developing unit, the detection images of a same color for different peripheral speeds of the developing unit at certain time intervals.

6. The image forming apparatus according to claim 5, wherein the control unit is configured to set, in a case where the change in tint greater than or equal to the predetermined amount does not occur, a peripheral speed smaller than or equal to the greatest peripheral speed of the developing unit used in forming the plurality of detection images as the image forming parameter.

7. The image forming apparatus according to claim 1, wherein the parameter is image data.

8. The image forming apparatus according to claim 7, wherein the control unit is configured to form, in a case where the plurality of detection images are formed with different image data, the detection images of a same color for different image data at certain time intervals.

9. The image forming apparatus according to claim 7, wherein the control unit is configured to form, in a case where the plurality of detection images are formed for different image data, detection images of a same color for different image data in a sequential order.

10. The image forming apparatus according to claim 9, wherein the image data is bit data, and the control unit is configured to set, in a case where the change in tint greater than or equal to the predetermined amount does not occur, a value smaller than or equal to a maximum value capable of being represented by the bit data as the image forming parameter.

11. The image forming apparatus according to claim 1, further comprising a voltage applying unit configured to apply a voltage to the developing unit, wherein the parameter is the voltage applied to the developing unit from the voltage applying unit.

12. The image forming apparatus according to claim 11, wherein the control unit is configured to fix, in a case where the plurality of detection images are formed with different voltages applied to the developing unit from the voltage applying unit and changed by amounts from a predetermined initial voltage, image data of the plurality of detection images.

13. The image forming apparatus according to claim 11, wherein the control unit is configured to form, in a case where the plurality of detection images are formed with different voltages applied to the developing unit from the voltage applying unit and changed by amounts from a predetermined initial voltage, the detection images of a same color for different voltages applied to the developing unit at certain time intervals.

14. The image forming apparatus according to claim 13, wherein the control unit is configured to, in a case where the change in tint greater than or equal to the predetermined amount occurs, a voltage within the range in which the voltage is changed as the image forming parameter.

15. The image forming apparatus according to claim 1, further comprising a charging unit configured to charge the photosensitive member, and an exposure unit configured to form a latent image on the photosensitive member charged by the charging unit, wherein the parameters are the potential of the photosensitive member charged by the charging unit and a latent image contrast value determined by an amount of exposure light provided by the exposure unit.

16. The image forming apparatus according to claim 1, wherein the developer is a two-component developer including toner and a carrier, and the parameter is a mixing ratio between the toner and the carrier.

17. The image forming apparatus according to claim 1, wherein the control unit is configured to determine a hue angle for each of the plurality of detection images based on a result of color measurement performed by the color measurement unit, and detect, from the plurality of detection images, a detection image at which a change in the hue angle occurs.

18. The image forming apparatus according to claim 1, further comprising a transfer unit configured to transfer a toner image formed on the photosensitive member to a recording material, and a fixing unit configured to fix the detection image transferred to the recording material by the transfer unit, wherein the color measurement unit is configured to measure the detection image on the recording material fixed by the fixing unit.

19. The image forming apparatus according to claim 18, further comprising a duplex conveying path configured to convey a recording material having an image formed on a first side of the recording material is conveyed along the duplex conveying path to form an image on a second side of the recording material wherein the color measurement unit is disposed in the duplex conveying path.

20. The image forming apparatus according to claim 1, further comprising a detection unit configured to detect a density of a developer image, wherein the control unit is configured to correct a tone of an image based on a result of detection performed by the detection unit in terms of a density of a developer image formed using the image forming parameter.

* * * * *